United States Patent [19]

Yamada et al.

[11] 4,282,840

[45] Aug. 11, 1981

[54] INTERNAL COMBUSTION ENGINE WITH ALTITUDE COMPENSATION DEVICE

[75] Inventors: Kenji Yamada, Aichi; Akira Takata; Akira Ii, both of Toyota; Katsuhiko Ohiwa, Handa, all of Japan

[73] Assignees: Nippondenso Co., Ltd., Kariya; Toyota Jidosha Kogyo Kabushiki Kaisha, Toyota, both of Japan

[21] Appl. No.: 123,424

[22] Filed: Feb. 21, 1980

[30] Foreign Application Priority Data

Feb. 22, 1979 [JP] Japan ..... 54-20004
Apr. 28, 1979 [JP] Japan ..... 54-57127[U]

[51] Int. Cl.[3] ..... F02P 5/04
[52] U.S. Cl. ..... 123/412; 123/438; 123/465
[58] Field of Search ..... 123/117 A, 117 R, 412

[56] References Cited

U.S. PATENT DOCUMENTS

| | | | |
|---|---|---|---|
| 3,828,743 | 8/1974 | Ludwig | 123/117 A |
| 3,982,553 | 9/1976 | Johnston | 123/117 A |
| 4,095,568 | 6/1978 | Furukawa | 123/117 A |
| 4,143,630 | 3/1979 | Akman | 123/117 A |
| 4,151,818 | 5/1979 | Tateno | 123/117 A |
| 4,159,013 | 6/1979 | Sawada | 123/117 A |

*Primary Examiner*—Ronald B. Cox
*Attorney, Agent, or Firm*—Cushman, Darby & Cushman

[57] ABSTRACT

An altitude compensation device for an internal combustion engine having a vacuum-operated ignition timing advancer and a carburetor has an atmospheric pressure variation responsive valve operative to control the air bleed of the carburetor and the vacuum fed to the vacuum advancer such that, as the atmospheric air pressure is lowered due to increase of the altitude, the air flow into the advancer vacuum chamber is decreased to advance the ignition timing while the air flow into the carburetor air bleed passage is increased to increase the air-fuel ratio of the air-fuel mixture produced by the carburetor.

9 Claims, 9 Drawing Figures

INTERNAL COMBUSTION ENGINE WITH ALTITUDE COMPENSATION DEVICE

BACKGROUND OF THE INVENTION

1. Field of the Invention

The present invention relates to an internal combustion engine with an altitude compensation device operative to automatically control the engine operation in accordance with the atmospheric air pressure which varies with the decrease and increase in the altitude at which a motor vehicle is placed.

2. Description of the Prior Art

It has been known to use an altitude compensation device operative to advance the ignition timing of an internal combustion engine when the atmospheric air pressure is decreased due to the increase in the altitude, to thereby compensate the output of the engine for the output power drop which would otherwise occur due to the decrease in the atmospheric air pressure. The prior art altitude compensation device for controlling the ignition timing advancer, however, is designed such that the ignition timing is contolled stepwise as the atmospheric pressure reaches predetermined levels. Thus, the ignition timing cannot be controlled continuously in accordance with the atmospheric pressure level at which the engine is operated.

It has also been known to use an altitude compensation device to control the air-fuel ratio of an air-fuel mixture produced by a carburetor. One type of the altitude compensation device comprises a set of solenoid valve and a duty cycle controlling circuit for controlling the ratio of the time periods while the solenoid valve is opened and closed, respectively. In general, a conventional carburetor is provided with a plurality of fuel circuits, such as main and slow circuits, and also with a power system. Thus, the altitude compensation means for a carburetor comprises a plurality of sets of solenoid valves and duty cycle controlling circuits. The prior art altitude compensation means for carburetor, therefore, are complicated in structure and increase the cost of manufacture of the carburetor.

SUMMARY OF THE INVENTION

It is a primary object of the present invention to provide an internal combustion engine with an altitude compensation device operative to continuously and precisely control the ignition timing of the engine in accordance with the atmospheric air pressure.

It is another object of the present invention to provide an internal combustion engine with an altitude compensation device which comprises a single set of solenoid valve and duty cycle controlling circuit which is operative to control the air bleed and power system of the carburetor and also control the ignition timing of the engine.

The internal combustion engine according to the present invention includes an intake system having a throttle valve disposed therein. A vacuum-operated ignition timing advancer has a vacuum chamber pneumatically connected by a vacuum line to a vacuum port formed in the intake system downstream of the throttle valve. A pressure regulator is disposed in the vacuum line and operative to produce an output vacuum of a substantially constant vacuum level to be introduced into the vacuum chamber of the ignition timing advancer. An altitude compensation device comprises means continuously responsive to variation in the atmospheric pressure to control the pressure level in the vacuum chamber of the ignition timing advancer such that the ignition timing is advanced as the atmospheric pressure is reduced.

In one embodiment of the present invention, the atmospheric pressure variation responsive means comprises a set of bellows member and a valve means or a set of a solenoid valve means and a duty cycle controlling circuit means.

In an internal combustion engine according to another embodiment of the present invention, the intake system includes a carburetor provided with at least one fuel circuit and a power system provided with a second vacuum chamber with a power piston disposed therein to control a power jet of the carburetor. The fuel circuit is connected with a first air bleed passage. The second vacuum chamber is connected with a second air bleed passage. The atmospheric pressure variation responsive means includes a solenoid valve means provided with first, second and third atmospheric air delivery ports. The first and second atmospheric air delivery ports are connected to the first and second air bleed passages. The third atmospheric air delivery port is connected through a third air bleed passage to the vacuum line at a point between the pressure regulator and the vacuum chamber of the advancer. The atmospheric pressure variation responsive means further includes pressure sensing means responsive to variation in the atmospheric pressure to produce an electric output signal and a duty cycle controlling circuit responsive to the electric output signal to control the operation of the solenoid valve means. The arrangement is such that, as the atmospheric air pressure is lowered due to the increase in the altitude, the solenoid valve means is operative to increase the atmospheric air flow into the first air bleed passage and decrease the atmospheric air flow into the second and third air bleed passage.

The above and other objects, features and advantages of the present invention will be made more apparent by the following description with reference to the accompanying drawings.

DESCRIPTION OF PREFERRED EMBODIMENTS

Figure 1:
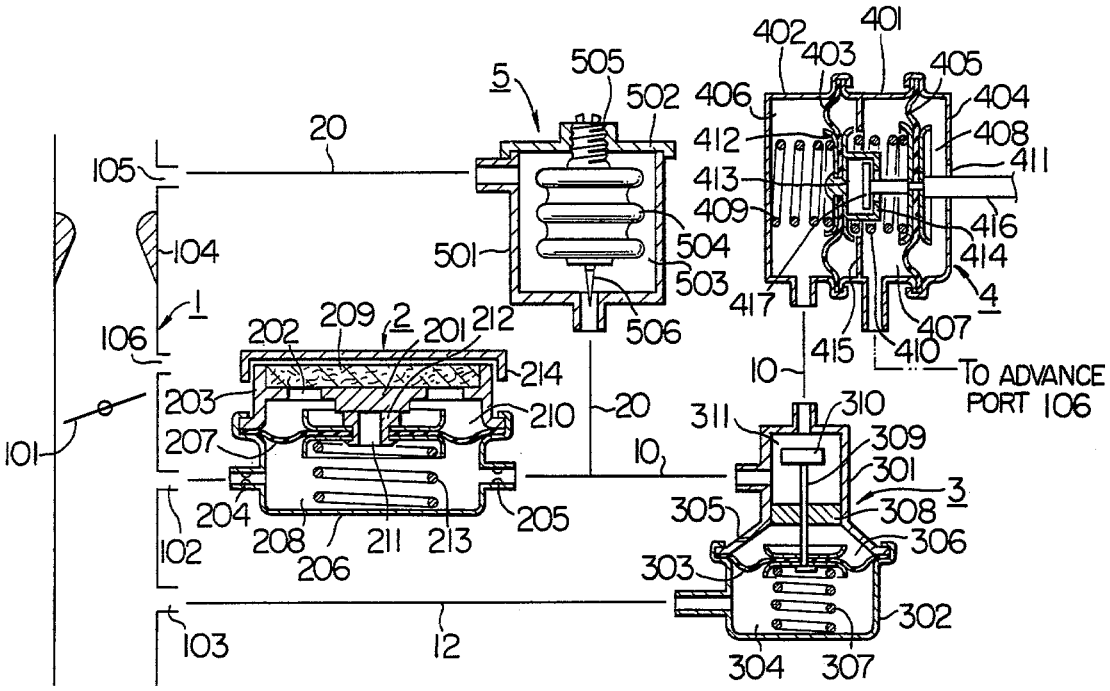
FIG. 1 is a partly sectional and partly diagrammatic illustration of an intake system of an internal combustion engine of an embodiment of the invention provided with an altitude compensation device for controlling the ignition timing in accordance with the atmospheric air pressure.

Referring first to FIG. 1, reference numeral 1 denotes an intake pipe of an internal combustion engine (not shown) with a throttle valve 101 provided in the intake pipe 1. First and second vacuum ports 102 and 103 are formed in the peripheral wall of the pipe 1 downstream of the throttle valve. An air extraction port 105 is formed in the intake pipe 1 upstream of a venturi 104. An advance port 106 is formed in the intake pipe 1 adjacent to and just upstream of the throttle valve 101.

A pressure regulator 2 is pneumatically connected to the first vacuum port 102 and comprises a housing formed of two parts 203 and 206. The housing port 203 provides a valve seat 201 and vent holes 202. A diaphragm 207 is clamped between the two housing parts 203 and 206 and cooperates therewith to define a first chamber 208 adjacent to the housing part 206 and a second chamber 210 adjacent to the housing part 203. The first chamber 208 is communicated with the vacuum port 102 through a fixed restriction orifice 204, while the second chamber 210 is in communication with the atmosphere through the vent holes 202 and a filter 209. The diaphragm 207 carries a valve member 212 mounted thereon substantially at the central part thereof and positioned in opposite relationship to the valve seat 201. The valve member 212 defines therein a throughhole 211 adapted to communicate the first chamber 208 with the second chamber 210. A compression coil spring 213 is disposed in the first chamber 208 to resiliently bias the diaphragm 207 upwardly. The filter 209 is covered with a cap member 214.

Figure 2:
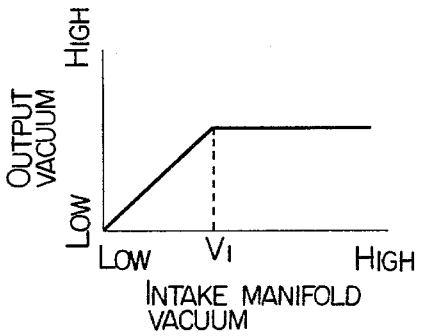
FIG. 2 is a graphical illustration of the operational characteristic of a pressure regulator shown in FIG. 1.

The pressure regulator 2 is arranged such that, when the intake manifold vacuum of the engine introduced into the pressure chamber 208 is increased beyond a predetermined vacuum level $V_1$ which is determined by the spring 213, the diaphragm 207 is downwardly deformed or displaced to move the valve member 212 away from the valve seat 201 to allow the atmospheric air to flow from the atmospheric pressure chamber 210 through the through-hole 211 in the valve member 212 into the pressure chamber 208 and such that, when the vacuum in the pressure chamber 208 is decreased beyond the predetermined vacuum level $V_1$, the diaphragm 207 is forced upwardly by the spring 213 to move the valve member 212 into sealing engagement with the valve seat 201 to interrupt the flow of air from the chamber 210 to the chamber 208. As such, the pressure chamber 208 is held substantially at a constant vacuum level so long as the intake manifold vacuum is higher than the predetermined vacuum level $V_1$. When the intake manifold vacuum is lower than the predetermined vacuum level $V_1$, the valve member 212 is kept in contact with the valve seat 201 to keep the vacuum level in the pressure chamber 208 equal to the intake manifold vacuum. Thus, the pressure regulator 2 has an output characteristic which is graphically shown in FIG. 2.

Reference numeral 3 denotes a vacuum controller comprising a housing formed by first and second housing parts 301 and 302. A diaphragm 303 is clamped between the housing members 301 and 302 and cooperates with the housing part 302 to define a pressure chamber 304. A bushing or partition 308 is disposed in the housing part 301 to cooperate therewith and with the diaphragm 303 to define an atmospheric pressure chamber 306 which is vented to the atmosphere by a vent hole 305. A compression coil spring 307 is disposed in the pressure chamber 304 to resiliently bias the diaphragm upwardly. A rod 309 is connected at one end to the diaphragm 303 and extends sealingly through a hole in the partition 308 into a third chamber 311 which is defined by the housing part 301 and the partition 308. A valve member 310 is disposed in the third chamber 311 and secured to the other end of the rod 309 for movement therewith.

The third chamber 311 of the vacuum controller 3 forms a part of a vacuum signal line 10 extending between the pressure regulator 2 and a vacuum advancer 4 to be discussed later. The pressure chamber 304 is pneumatically connected to the second vacuum port 103 by a vacuum line 12. When the intake manifold vacuum introduced into the pressure chamber 304 is lower than a predetermined vacuum level which is determined by the spring 307, the diaphragm 303 is upwardly deformed or displaced to move the valve member 310 into a position in which the valve member 310 blocks the vacuum signal line 10. The predetermined vacuum level determined by the spring 307 may preferably be equal to or slightly greater than the vacuum level $V_1$ determined by the spring 213 of the pressure regulator 2.

The vacuum advancer 4 is provided for a conventional vacuum-operated ignition timing control device (not shown) which is incorporated into a distributor housing of the engine (not shown). The vacuum advancer 4 comprises a housing including first and second housing parts 401 and 402 between which a first diaphragm 403 is clamped. A second diaphragm 405 is clamped between the first housing part 401 and a third housing part 404. These members cooperate together to define first to third chambers 406, 407 and 408. The first chamber 406 accommodates a first spring 409 resiliently biasing the diaphragm 403 toward the second chamber 407 and is pneumatically connected to the vacuum signal line 10. The second chamber 407 accomodates a second spring 410 resiliently biasing the diaphragms 403 and 405 away from each other and is pneumatically connected to the advance port 106 by a conduit which is not shown for the simplification of the drawings. The third chamber 408 is vented to the atmosphere through an opening 411. The central section of the first diaphragm 403 is clamped between generally circular first and second clamp members 412 and 413. The second clamp member 413 is disposed in the chamber 407 and has radially inwardly bent fingers 414. The housing part 401 has stops 415 radially inwardly extending therefrom into the chamber 407 and disposed in the path of axial movement of the clamp member 413 to limit the rightward movement thereof. A rod 416 is secured to the second diaphragm 405 and has opposite end portions extending axially therefrom. One end of the rod 416 extends into the chamber 407 and carries a flange 417 disposed between the clamp member 413 and the fingers 414 for limited axial movement therebetween. The other end of the rod 416 is operatively connected to a movable breaker plate of the distributor (not shown).

As the vacuum introduced into the first chamber 406 is increased, the first diaphragm 403 is deformed leftwards as viewed in FIG. 1 so that the flange 417 of the rod 416 is engaged by the fingers 414 with a result that the rod 416 and the second diaphragm 405 are also displaced leftwards to rotate the breaker plate for thereby advancing the ignition timing. In addition, as the vacuum introduced into the second chamber 407 is increased, the second diaphragm 405 and the rod 416 are displaced leftwards independently of the first diaphragm 403 to also advance the ignition timing.

Figure 3:
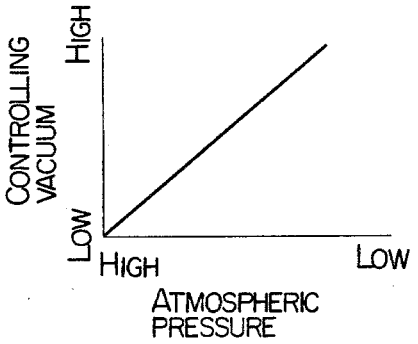
FIG. 3 is a graphical illustration of the relationship between the atmospheric pressure and the ignition timing controlling vacuum which is controlled by the altitude compensation device shown in FIG. 1.

The air extraction port 105 is connected by an air line 20 to the vacuum signal line 10 between the pressure regulator 2 and the vacuum controller 3. A bleed air controller 5 is disposed in the air line 20 and comprises a housing formed by first and second housing parts 501 and 502 secured together to define a chamber 503 which forms a part of the air line 20. A bellows member 504, the interior of which is kept at a constant vacuum level, is disposed in the chamber 503 and mounted at one end on the housing part 502 by means of an adjust screw 505 so that the position of the bellows member 504 relative to the housing part 502 can be adjusted by turning the screw 505. The bellows member 504 has a tapered needle valve 506 secured to the other end thereof and adapted to vary the air-flowing sectional area of the air line 20. More specifically, when the atmospheric pressure is lowered, the bellows member 504 is axially expanded to move the needle valve 506 into the air line 20 to decrease the air-flowing sectional area thereof for thereby decreasing the flow of the bleed air therethrough from the port 105 to the vacuum signal line 10. Thus, if the output vacuum of the pressure regulator 2 is kept constant, the controlling vacuum introduced through the vacuum signal line 10 into the first chamber 406 of the vacuum advancer 4 will be increased in proportion to the decrease in the atmospheric pressure, as graphically shown in FIG. 3.

The operation of the system described above will be explained hereunder. When the intake manifold vacuum is higher than the predetermined vacuum level $V_1$, the valve member 310 of the vacuum controller 3 is in its open position so that the controlling vacuum is introduced through the vacuum signal line 10 into the first chamber 406 of the vacuum advancer 4. In this position of the vacuum controller 3, the decrease in the atmospheric pressure (i.e., the increase in the altitude) will advance the ignition timing. Thus, it would be appreciated that the ignition timing control can compensate for the engine output drop which would otherwise occur due to the decrease in the atmospheric pressure. In addition, the second chamber 407 of the vacuum advancer 4 is pneumatically connected to the advance port 106 so that the ignition timing is also controlled in accordance with the degree of opening of the throttle valve 101. During acceleration operation of the engine, the throttle valve 101 will be widely open with resultant decrease in the output vacuum of the pressure regulator 2 and in the controlling vacuum in the vacuum signal line 10. However, when the intake manifold vacuum is lowered beyond the predetermined vacuum level $V_1$, the diaphragm 303 of the vacuum controller 3 moves the valve member 310 to its closed position to seal the first chamber 406 of the vacuum advancer 4 from the pressure regulator 2 and also from the bleed air controller 5 so that the chamber 406 is kept at a vacuum level which has been adjusted in accordance with the atmospheric pressure.

Figure 4:
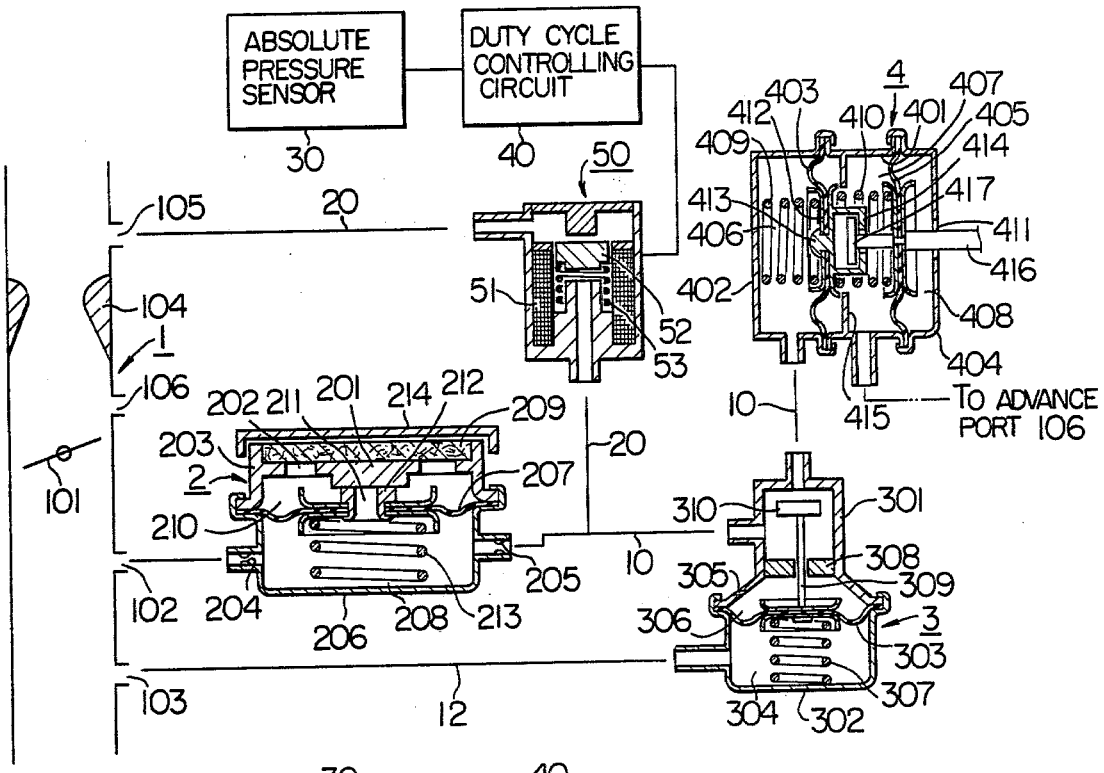
FIG. 4 is a view similar to FIG. 1 but illustrates a first modification of the embodiment shown in FIG. 1.

FIG. 4 shows a first modification of the embodiment of the invention shown in FIG. 1. The modification consists of replacement of the bleed air controller 5 of the described embodiment by a solenoid valve 50 which is electrically controlled by a combination of an absolute pressure sensor 30 and a duty cycle controlling circuit 40 which is operative to control the ratio between the time periods while the solenoid valve 50 is electrically energized and deenergized, respectively.

Figure 5:
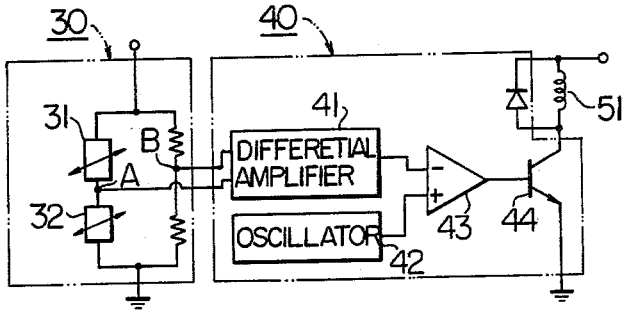
FIG. 5 illustrates the electric circuits of the absolute pressure sensor and the duty cycle controlling circuit shown in FIG. 4.
Figure 5A:
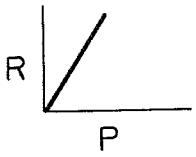
FIGS. 5A and 5B illustrate the operational characteristics of the pressure sensitive elements shown in FIG. 5, respectively.
Figure 5B:
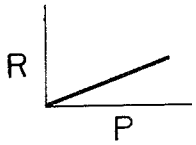

Referring to FIGS. 5, 5A and 5B, the absolute pressure sensor 30 includes first and second pressure sensitive elements 31 and 32 which are electrically connected as shown in FIG. 5. The first pressure sensitive element 31 provides an operation characteristic such that the electrical resistance R increases with the increase in the atmospheric pressure P, as shown in FIG. 5A. The second pressure sensitive element 32 provides a generally similar operation characteristic, but the element 32 provides a more moderate increase of the electrical resistance, as shown in FIG. 5B. Thus, as the atmospheric pressure rises, the potential difference between the points A and B in FIG. 5 will be increased. This potential difference is amplified by a differential amplifier 41 of the duty cycle controlling circuit 40. The circuit 40 also includes an oscillator 42 which produces a constant frequency of a triangular or saw-toothed waveform. The output voltages of the differential amplifier 41 and the oscillator 42 will be put into a comparator 43 which produces an output which in turn is applied to a transistor 44 to control the same. The solenoid valve 50 includes a coil 51 electrically connected to the transistor 44 of the circuit 40. A plunger or valve member 52 is disposed in the air line 20. When the coil 51 is electrically energized, the valve member 52 is downwardly moved against a spring 53 into a position in which the air line 20 is blocked by the valve member. When the coil 51 is deenergized, the valve member 52 is moved to its open position by the spring 53.

With the circuit arrangement shown in FIG. 5, the transistor 44 is switched on only when the output voltage of the differential amplifier 41 is higher than the output voltage of the oscillator 42. Thus, as the atmospheric pressure rises, the time period while the coil 51 is electrically energized is decreased and the time period while the coil 51 is deenergized is increased. Thus, the solenoid valve 50 in combination with the absolute pressure sensor 30 and the duty cycle controlling circuit 40 is operative to provide a vacuum-advancer controlling vacuum of a characteristic similar to that shown in FIG. 3.

Figure 6:
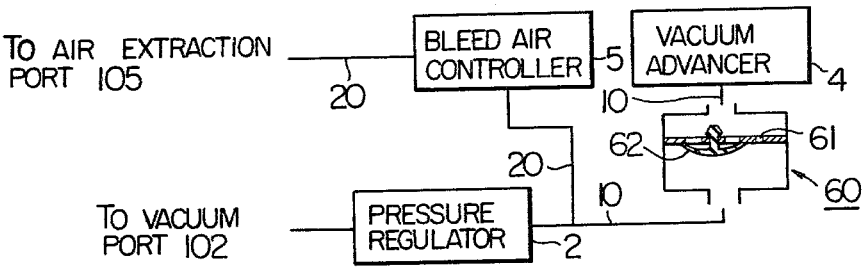
FIG. 6 is a diagrammatic illustration of a second modification of the embodiment shown in FIG. 1.

FIG. 6 shows a second modification in which the vacuum controller 3 of the embodiment shown in FIG. 1 is replaced by a delay valve means 60 which comprises a very small orifice 61 and a check valve 62 which is disposed in the vacuum signal line in parallel relationship with the orifice 61. This arrangement will assure that, even if the intake manifold vacuum is lowered due, for example, to the movement of the throttle valve 101 to a wide-open position for the acceleration of the engine, the vacuum level in the first chamber 406 of the vacuum advancer 406 can be prevented from being abruptly lowered because the chamber 406 of the vacuum advancer is communicated at this time with the pressure regulator 2 through the small orifice 61 only. As soon as the engine resumes its normal operating condition, the check valve 62 will be opened to transmit the predetermined controlling vacuum into the chamber 406 of the vacuum advancer 4. It will be appreciated that the very small size of the orifice 61 will not adversely affect the altitude-compensation operation of the system because the change of the atmospheric pressure (i.e., the variation in the altitude) occurs very slowly.

The bleed air controller 5 included in the system shown in FIG. 6 may be replaced by the set of the solenoid valve 50, the absolute pressure sensor 30 and the duty cycle controlling circuit 40 shown in FIGS. 4-5B.

As described, the ignition timing of an internal combustion engine can be continuously and precisely controlled in accordance with the variation in the atmospheric pressure.

Figure 7:
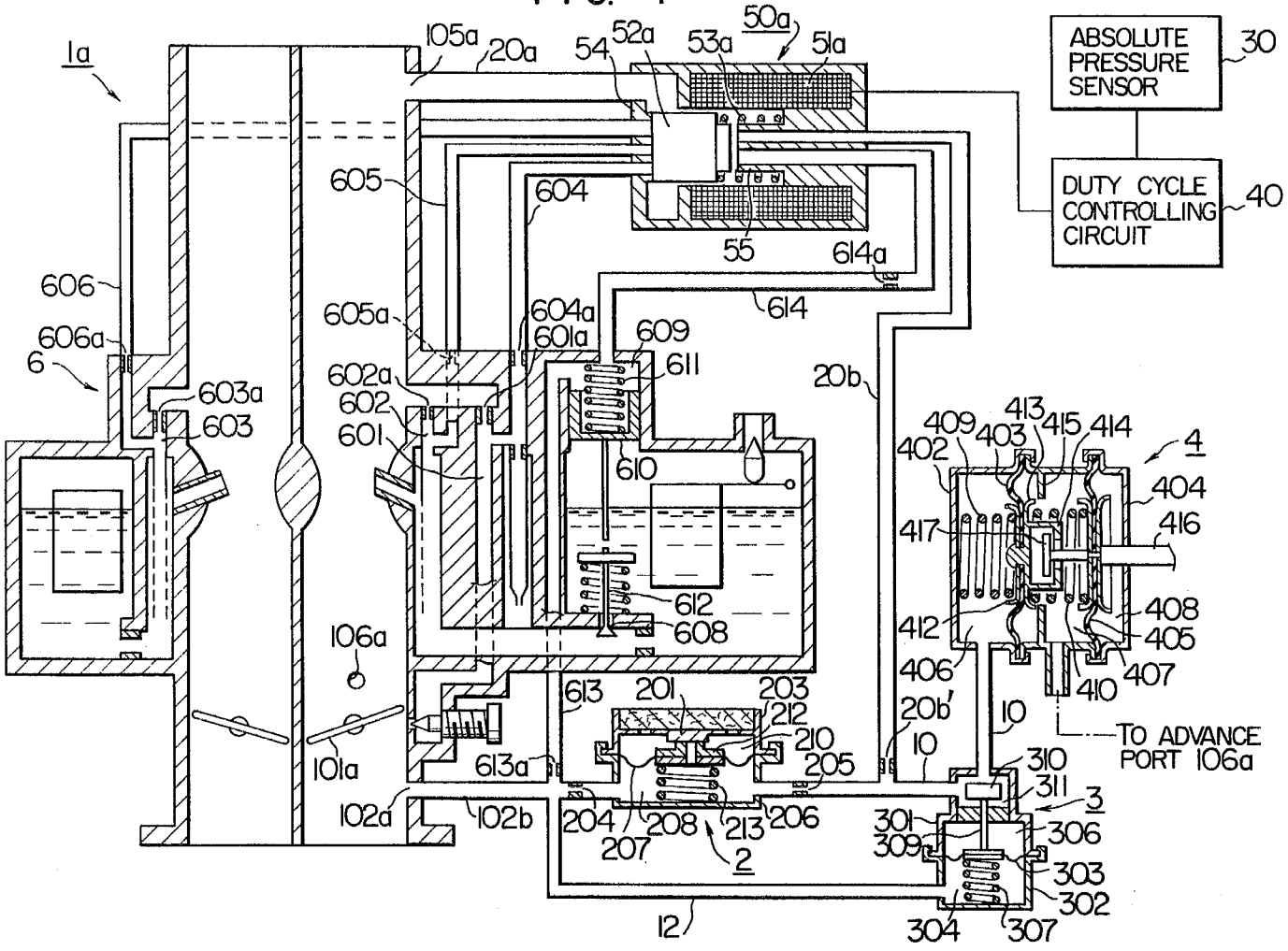
FIG. 7 is a view generally similar to FIG. 1 but illustrates an internal combustion engine of a second embodiment of the present invention provided with an altitude compensation means for controlling the air bleed of a carburetor and also the ignition timing of the engine.

FIG. 7 shows a second embodiment of the invention. An intake system of an internal combustion engine (not shown) is generally designated by reference numeral 1*a* and includes a carburetor 6 including a slow circuit including a main air bleed passage 601 having an orifice 601*a* provided therein. The carburetor also includes a primary main circuit including a main air bleed passage 602 having an orifice 602*a* provided therein. A secondary main circuit includes a main air bleed passage 603 having an orifice 603*a* provided therein. Auxiliary air bleed passages 604, 605 and 606 are provided in parallel relationship to the passages 601, 602 and 603. Orifices 604*a*, 605*a* and 606*a* are provided in the auxiliary bleed passages 604, 605 and 606, respectively. The carburetor 6 also includes a power system including a power jet 608 which is adapted to be opened to increase the engine output when the intake manifold vacuum downstream of a throttle valve 101*a* is lowered beyond a predetermined vacuum level. For this purpose, the power system includes a vacuum chamber 609, a power piston 610 disposed in the vacuum chamber 609 for sliding movement therein, a compression coil spring 611 disposed in the vacuum chamber to resiliently bias the piston downwardly, and a power valve 612 adapted to be driven by the power piston 610 to open and close the power jet 608. The vacuum chamber 609 is pneumatically connected through a vacuum passage 613 to a vacuum conduit 102*b* which in turn is connected to a vacuum port 102*a* formed in the peripheral wall of the carburetor 6 downstream of the throttle valve 101*a*. A restriction orifice 613*a* is provided in the vacuum passage 613.

The vacuum conduit 102*b* is also connected with a vacuum-operated ignition timing controlling system which is substantially similar in structure and operation to the ignition timing controlling system described with reference to FIG. 4. The parts similar to those in FIG. 4 are designated by similar reference numerals.

A modified solenoid valve 50*a* comprises a generally cylindrical housing which accomodates a coil 51*a* electrically connected to a duty cycle controlling circuit 40 which in turn is electrically connected to an absolute pressure sensor 30 as in the embodiment shown in FIG. 4. The sensor 30 and the circuit 40 are similar in structure and function to the sensor 30 and circuit 40 shown in FIG. 4. The solenoid valve housing is pneumatically connected at one end by an air passage 20*a* to an air extraction port 105*a* formed in the carburetor 6 upstream of the venturi thereof. This end of the solenoid valve housing provides a flat valve seat 54 defining therein three ports which are connected to the auxiliary bleed passages 604, 605 and 606 of the carburetor 6, respectively. A stator core 55 is surrounded by the coil 51*a* and connected at the outer end to the other end of the housing. The stator core 55 provides a second flat valve seat which defines therein two ports which in turn are pneumatically connected to the vacuum signal line 10 of the ignition timing controlling system and to the vacuum chamber 609 of the power system of the carburetor 6, respectively, by bleed passages 20*b* and 614. Restriction orifices 20*b'* and 614*a* are provided in the bleed passages 20*b* and 614, respectively. A plunger or valve member 52*a* is disposed between the first and second valve seats 54 and 55 and is movable between a first position in which the valve member 52*a* is in sealing engagement with the first valve seat 54 and a second position in which the valve member is in sealing engagement with the second valve seat 55. A compression coil spring 53*a* is provided between the valve member 52*a* and the second valve seat 55 to resiliently bias the valve member 52*a* against the first valve seat 54.

The absolute pressure sensor 30 and the duty cycle controlling circuit 40 cooperate with the solenoid valve 50*a* to control the air bleed such that, as the atmospheric pressure is increased, the duration of the communication between the air passage 20*a* with the auxiliary bleed passages 604, 605 and 606 is shortened and the duration of communication between the passage 20*a* with the bleed passages 20*b* and 614 is extended, and vice versa. Accordingly, as the motor vehicle climbs up a hill or mountain with a resultant decrease in the atmospheric pressure, the rates of the air bleed through the auxiliary bleed passages 604–606 are increased with a resultant decrease in the fuel supply into the engine so that the mixture fed into the engine is maintained at a proper air-fuel ratio. The flows of air through the auxiliary bleed passages 604–606 are regulated by the restriction orifices 604*a*, 605*a* and 606*a* provided in these passages, respectively.

The air flow through the air bleed passage 614 into the vacuum chamber 609 of the power system of the carburetor 6 is decreased with the decrease in the atmospheric pressure. Thus, assuming that the power piston 110 of the power system is adapted to be downwardly actuated to open the power jet 608 when the motor vehicle is running on a lowland and when the intake manifold vacuum is lower than −120 mmHg, for example, the power jet 108 will not be opened with the intake manifold vacuum of −120 mmHg if the motor vehicle is running on a highland. On highland, the power jet 608 will be opened after the intake manifold vacuum is lowered beyond −120 mmHg.

The flow of the bleed air through the air bleed passage 20*b* is decreased with the decrease in the atmospheric pressure (i.e., increase in the altitude), and vise versa. Thus, the controlling vacuum in the vacuum signal line 10 and thus in the chamber 406 of the vacuum advancer 4 will be increased to advance the ignition timing as the atmospheric pressure is lowered, and vise versa, as in the embodiment described with reference to FIGS. 1 to 5B.

The solenoid valve 50*a* is shown as being prepared independently of the carburetor 6. This solenoid valve, however, may be integral with the carburetor.

What is claimed is:

1. An internal combustion engine including an intake system having a throttle valve disposed therein, a vacuum-operated ignition timing advancer having a vacuum chamber pneumatically connected by a vacuum line to a vacuum port formed in said intake system downstream of said throttle valve, a pressure regulator disposed in said vacuum line and being operative to produce an output vacuum of a substantially constant vacuum level to be introduced into said vacuum chamber, and means continuously responsive to variation in the atmospheric pressure to continuously control the pressure level in said vacuum chamber such that the ignition timing is advanced as the atmospheric pressure is reduced.

2. The internal combustion engine according to claim 1, wherein said atmospheric pressure variation responsive means comprises a bleed air controller including a bellows member responsive to variation in the atmospheric pressure and a valve means operatively associated with said bellows member to control the flow of the atmospheric air into said vacuum chamber.

3. The internal combustion engine according to claim 1, wherein said atmospheric pressure variation responsive means comprises a solenoid valve means operative to control the flow of the atmospheric air into said vacuum chamber, pressure sensing means responsive to variation in the atmospheric pressure to produce an electrical output signal and a duty cycle controlling circuit responsive to said electrical signal to control the operation of said solenoid valve means.

4. The internal combustion engine according to claim 2 or 3, wherein said atmospheric pressure variation responsive means has an atmospheric air delivery port pneumatically connected to said vacuum line at a point between said pressure regulator and said vacuum chamber of said vacuum advancer, and wherein a vacuum controlling means is disposed in said vacuum line between said vacuum advancer and said point, said vacuum controlling means being responsive to variation in the engine intake manifold vacuum to control the feed of the controlling vacuum through said vacuum line into said vacuum chamber of said vacuum advancer.

5. The internal combustion engine according to claim 4, wherein said vacuum controlling means comprises a vacuum controlling valve means operative to pneumatically disconnect said vacuum chamber of said vacuum advancer from said pressure regulator and said atmospheric pressure variation responsive means when the intake manifold vacuum is lowered beyond a predetermined vacuum level.

6. The internal combustion engine according to claim 4, wherein said vacuum controlling means comprises a delay valve means including a check valve and a restriction orifice disposed in said vacuum line in parallel relationship with each other, said check valve being closed when the intake manifold vacuum is lowered beyond a predetermined vacuum level.

7. The internal combustion engine according to claim 1, wherein said intake system includes a carburetor provided with at least one fuel circuit and a power system provided with a second vacuum chamber and a power piston to control a power jet of said carburetor, said fuel circuit being connected with a first air bleed passage, said second vacuum chamber being connected with a second air bleed passage, said atmospheric pressure variation responsive means including a solenoid valve means provided with first, second and third atmospheric air delivery ports, said first and second atmospheric air delivery ports being connected to said first and second air bleed passages, said third atmospheric air delivery port being connected through a third air bleed passage to said vacuum line at a point between said pressure regulator and said vacuum chamber of said vacuum advancer, said atmospheric pressure variation responsive means further including pressure sensing means responsive to variation in the atmospheric pressure to produce an electrical output signal and a duty cycle controlling circuit responsive to said electric signal to control the operation of said solenoid valve means, the arrangement being such that, as the atmospheric air pressure is lowered, said solenoid valve means is operative to increase the atmospheric air flow into said first air bleed passage and decrease the atmospheric air flow into said second and third air bleed passages.

8. The internal combustion engine according to claim 7, wherein a vacuum controlling means is disposed in said vacuum line between said vacuum advancer and said point and responsive to variation in the engine intake manifold vacuum to control the feed of the controlling vacuum through said vacuum line into said vacuum chamber of said vacuum advancer.

9. The internal combustion engine according to claim 8, wherein said vacuum controlling means comprises a vacuum controlling valve means operative to pneumatically disconnect said vacuum chamber of said vacuum advancer from said pressure regulator and said solenoid valve means when the intake manifold vacuum is lowered beyond a predetermined vacuum level.

* * * * *